US005502987A

United States Patent [19]

Zorini

[11] Patent Number: 5,502,987

[45] Date of Patent: Apr. 2, 1996

[54] PROCESS FOR CONTROLLING THE HORIZONTAL MOVEMENTS OF YARN CARRIER BARS CORRELATED WITH A PREDETERMINED DISTANCE BETWEEN CENTERS OF THE KNITTING NEEDLES IN KNITTING MACHINES

[75] Inventor: Luigi O. Zorini, Cilavegna, Italy

[73] Assignee: Comez, S.p.A., Pavia, Italy

[21] Appl. No.: 302,588

[22] Filed: Sep. 8, 1994

[30] Foreign Application Priority Data

May 24, 1994 [EP] European Pat. Off. ..... 94830247

[51] Int. Cl.[6] ..... D04B 27/20; G06F 15/46

[52] U.S. Cl. ..... 66/207; 66/203; 364/470

[58] Field of Search ..... 66/203, 204, 205, 66/206, 207; 364/470, 132, 138, 139

[56] References Cited

U.S. PATENT DOCUMENTS 5,259,216 11/1993 Zorini ..... 66/205 X
5,307,648 5/1994 Forkert et al. ..... 66/203 X
5,311,751 5/1994 Winter et al. ..... 66/203 X

*Primary Examiner*—John J. Calvert

*Attorney, Agent, or Firm*—Laff, Whitesel, Conte & Saret

[57] ABSTRACT

A system for controlling the horizontal movements of yarn carrier bars in an automatic loom or knitting machine includes a plurality of yarn carrier bars mounted for horizontal movement, a respective stepper motor operatively connected to each yarn carrier bar to control its movement, a respective programmable motor control unit electrically coupled to each stepper motor, a programmable central controller electrically coupled to all motor control units, an electrical power supply, and an energy storage means which provides sufficient energy for operation of the stepper motors and control units for a short period when power from the power supply is unavailable. Each stepper motor includes an output shaft, and a respective shaft position encoder measures and supplies output shaft position information to the motor control unit. Each motor control unit has means for storing certain parameters needed to control a corresponding stepper motor to drive the corresponding yarn carrier bar to produce the desired weaving or knitting action. According to a method for operating the control system, if the power supply fails, the motor control units drive the motors using energy from the energy storage means according to the parameters to ensure safe operation of the bar without interference with other components, and to align each bar in a respective rest position.

17 Claims, 1 Drawing Sheet

PROCESS FOR CONTROLLING THE HORIZONTAL MOVEMENTS OF YARN CARRIER BARS CORRELATED WITH A PREDETERMINED DISTANCE BETWEEN CENTERS OF THE KNITTING NEEDLES IN KNITTING MACHINES

BACKGROUND OF THE INVENTION

1. Field of the Invention

The present invention relates to a process for controlling the horizontal movements of yarn carrier bars, correlated with a predetermined distance between centres of the knitting needles in knitting machines, comprising the use of a plurality of stepping motors each operatively connected to a yarn carrier bar for transmitting reciprocating movements having variable-width strokes to said bar, as well as a central control unit managing working cycles carried out by said stepping motors.

By working cycle it is intended an entire plurality of movements aiming at knitting any finished pattern top be made by the knitting machine.

2. Prior Art

It is known that in fast knitting machines, such as crochet galloon looms, the formation of a manufactured article relies on the cooperation of different knitting members, such as needles, eye-pointed needles and tubular weft yarn guides or threading tubes, provided with a reciprocating movement synchronized in such a manner as to give rise to the interlacing of weft yarns engaged through the threading tubes, with the warp yarns passing through the eye-pointed needles and operatively engaging about the needles. The threading tubes are arranged in one or more rows disposed parallelly in side by side relation, each of which is supported by a corresponding yarn carrier bar through which the necessary reciprocating motions are transmitted so that the threading tubes may describe, by turns at each work stroke, a given trajectory selectively extending astride of one or more needles.

To this end, the yarn carrier bars are engaged, at the respective opposite ends, to a pair of lifting plates simultaneously driven in an oscillatory motion by a vertical-movement mechanical linkage. In addition, operating on each of the yarn carrier bars is a second mechanical linkage giving the bar itself, and therefore the corresponding threading tubes, a horizontal oscillatory movement which, in combination with the above mentioned vertical movement, makes the threading tubes describe displacements according to a curved trajectory astride of the needles. By varying each time the width of the horizontal strokes of the individual yarn carrier bars, the threading tubes are induced to selectively ride over one or more needles concurrently with the formation of each knitting stitch, so as to give origin to the desired pattern or embroidery on the manufactured article.

In knitting machines of the most usual conception, the reciprocating movement of the individual yarn carrier bars is achieved with the aid of the so-called "Glieder chains", consisting each of a plurality of suitably shaped cam elements, interlinked one after the other in an endless line. The cam elements of the individual Glieder chains, mounted on appropriate driving pulleys set in rotation, act on respective cam followers associated with the individual yarn carrier bars in order to cause the horizontal movement of the latter according to a width each time proportional to the lifting of the cam element coming into engagement with the cam follower.

The Applicant has recently developed a device that, in place of said Glieder chains, utilizes a plurality of electric stepping motors operatively connected each with one of the yarn carrier bars. The selective operation of the stepping motors is managed by a programmable electronic control box into which any programs relating to the management of the motors themselves can be easily loaded, according to a work cycle suitable to obtain the desired pattern or embroidery in the manufactured article produced by the machine. In substance, the program loaded into the electronic control box contains all information relating to the extent of the stroke to be carried out, upon command of the respective motor, by each of the yarn carrier bars, at each knitting step. In order to give the control box the possibility of stopping each stepping motor the exact moment at which the yarn carrier bar has moved by the expected amount, a plate-like element is arranged on the output shaft of each of the stepping motors, which plate-like element is provided with optical references spaced apart from each other an amount corresponding to the distance between centres of the needles. Optical detectors interlocked to the control box and combined with each of the motors detect when the optical reference passes a predetermined reading point. Therefore the control box itself is capable of evaluating the number of needles ridden over by the threading tubes as a result of the movements of each yarn carrier bar so as to stop the horizontal movement of said bar at the appropriate moment.

Each stepping motor is also equipped with a blocking mechanism adapted to intervene whenever the power supply to the knitting machine is broken, in order to ensure that the corresponding yarn carrier bar is stopped at a position adapted to enable the threading tubes to be inserted between the needles in the absence of mechanical interferences during the vertical strokes that are unavoidably carried out by the yarn carrier bars under inertia: before the knitting machine thoroughly stops. Each of these blocking mechanisms consists of a sector gear connected to the output shaft of the corresponding motor. This sector gear, the teeth of which are spaced apart an amount corresponding to the distance between centres of the needles, is designed to be engaged by a fitting wedge that, during the usual operation of the machine, is held by an electromagnet couteracting the elastic action of a spring. In the lack of current, the resulting de-energizing of the electromagnet causes the engagement of the fitting wedge between two consecutive teeth of the sector gear and, as a result, locking of the yarn carrier bar at a position adapted to avoid mechanical interferences between the threading tubes and the needles.

Although the use of stepping motors with movement devices represents an important technical progress as compared to the use of Glieder chains, said movement devices have proved to be capable of further improvements under different points of view.

For example, it has been found that detection of the optical reference passage before the reading point does not completely meet the requisite reliability and accuracy in the control of the stroke carried out by the individual yarn carrier bars. In fact, it is very difficult, above all at high operating speeds of the machine, to carry out stopping of the yarn carrier bar at a location sufficiently exact to avoid the risk of mechanical interference between the threading tubes and the needles, above all when a very high working fineness is required, that is when the distance between centres of the knitting needles is very reduced. In addition, in the case that, for any reason, one or more yarn carrier bars should undergo accidental shiftings that are not governed by the electronic control box, the control of the bar positioning would be permanently impaired as far as an operator intervenes and resets the entire movement device. This is essentially due to the fact that the electronic control box is exclusively capable of carrying out counting of the optical references passing before the reading points and does not have the possibility of executing any precise monitoring as regards the actual position of the yarn carrier bars in relation to the angular positioning of the output shafts of the stepping motors. In particular, it may happen that, due to vibrations or any other reason, an optical reference stopping at the reading point may slightly move back and, subsequently, reach again the reading point. The electronic control box would interpret such a circumstance as a displacement of the yarn carrier bar by an amount equal to the distance between centres of the needles whereas, as a matter of fact, the bar has not substantially moved.

It is also to be pointed out that in the above described device operation of the stepping motors takes place at a predetermined and constant speed that, in order to reduce the risks of mechanical interferences when the machine is running at high speeds, must correspond to the highest speed that the motors can reach. As a result the mechanical members connected to the yarn carrier bar are greatly stressed even in cases in which said bar would have to carry out a limited displacement and consequently operation of the corresponding motor could take place at a reduced speed without involving risks of mechanical interferences between the knitting members.

It will be also recognized that the plate-like elements carrying the optical references must be replaced every time the knitting machine is set up for executing workings having a fineness or stitch gauge different from the preceding one.

Also the sector gears of the above mentioned blocking mechanisms must be replaced each time the working fineness is changed and, in addition, apart from that, the presence of said sector gears makes the device as a whole much more complicated.

SUMMARY OF THE INVENTION

It is the main object of the invention to solve the above drawbacks by providing a process for controlling the horizontal movement of yarn carrier bars, correlated with a predetermined distance between centres of the knitting needles in knitting machines, at any step of the working cycle and also in case of emergency or sudden halt.

The foregoing and further objects that will become more apparent in the course of the following description are achieved by a process for controlling the horizontal movement of yarn carrier bars, correlated with a predetermined distance between centres of the knitting needles in knitting machines as defined in the first claim and in the subsequent ones.

BRIEF DESCRIPTION OF THE DRAWINGS

Further features and advantages will be more fully understood from the detailed description of a preferred embodiment of a process for controlling the horizontal movement of yarn carrier bars correlated with a predetermined distance between centres of the knitting needles in knitting machines in accordance with the present invention, given hereinafter by way of non-limiting example with the aid of the accompanying drawing in which the only FIGURE (FIG. 1) is a diagrammatic view of a portion of a knitting machine equipped with stepping motors governed by a central control unit and each of which is associated with a respective microprocessor unit provided with a control firmware in accordance with the present invention.

DESCRIPTION OF THE PREFERRED EMBODIMENT

Figure 1:
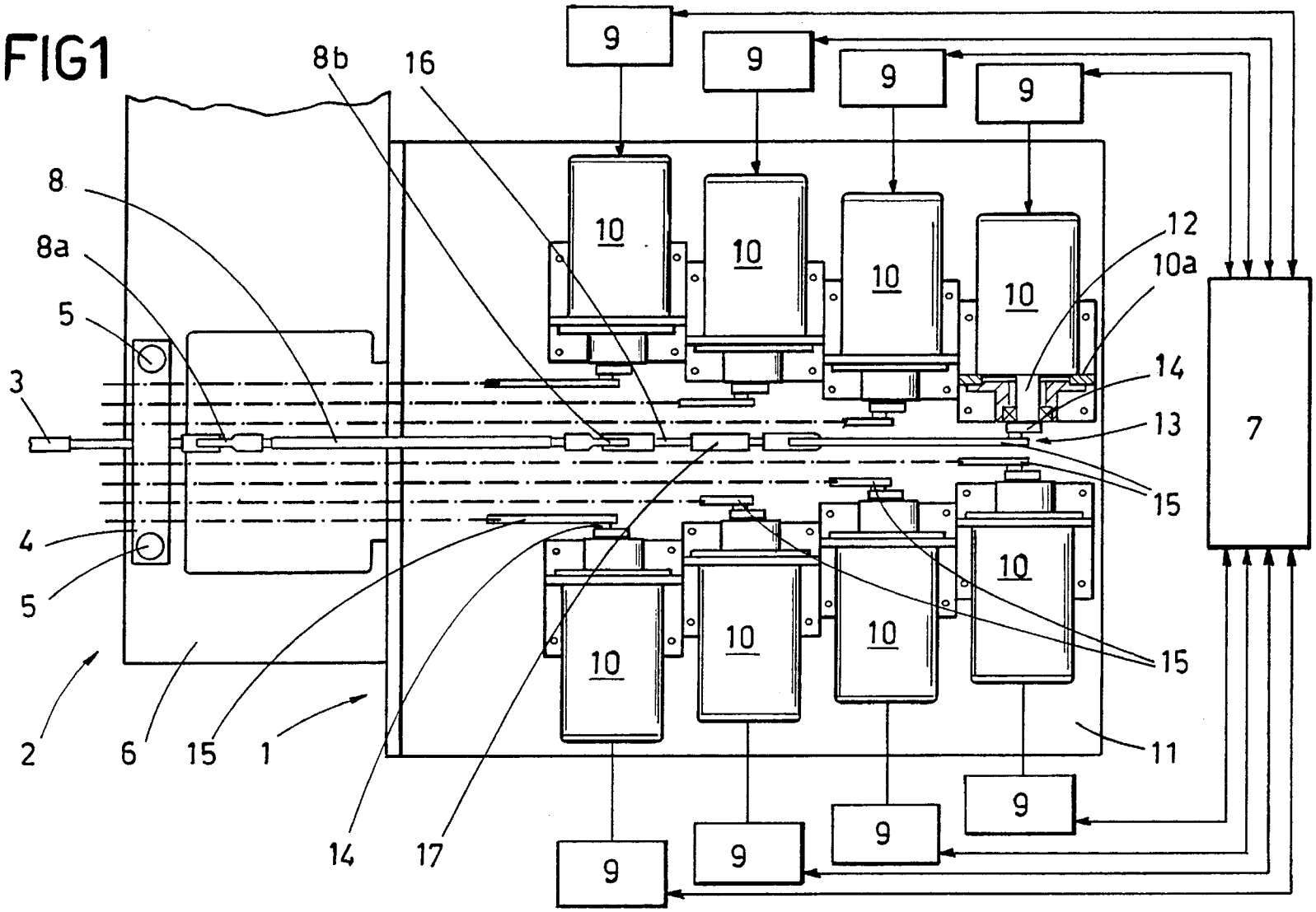

Referring to FIG. 1 a device for the horizontal movement of yarn carrier bars in a knitting machine has been generally identified by reference numeral 1. The device 1 is associated with a knitting machines and more particularly a crochet galloon loom 2 and is arranged to act on one or more yarn carrier bars 3 (only one of which is shown) to cause the reciprocating motion of same.

The yarn carrier bars 3, in known manner, carry a plurality of threading tubes, not shown, engaging respective weft yarns, not shown, and are operatively supported by at least two lifting plates 4 (only one of which is shown) slidably engaging said bars 3 according to a horizontal direction coinciding with the longitudinal extension of the yarn carrier bars themselves.

Each lifting plate 4 is slidably guided in a vertical direction on a pair of guide rods 5 integral with a bed 6 of the knitting machine and the plates are simultaneously operated in a reciprocating motion along the rods by a mechanical linkage consisting of a connecting rod-crank assembly housed in the machine bed and not shown as known per se and conventional.

The composition of the vertical oscillatory motion and horizontal oscillatory motion imparted to each yarn carrier bar 3, through the device 1, is such that the engaged threading tubes are driven in a reciprocating motion according to a substantially curved trajectory extending astride of one or more knitting needles (not shown in the drawing).

The device 1 provides for the presence of a plurality of driving rods 8, each of which has one end **8*a* operatively linked to the end of one of the bars 3, as well as a second end 8*b* connected to an electric stepping motor 10 fastened, by a supporting bracket 10*a*, to a bearing framework 11 integral with the machine bed 6**.

Each stepping motor 10, known per se and conventional, lends itself to drive in rotation a respective output shaft 12 according to angular steps in succession having each a given angular width. The output shaft 12 of each stepping motor 10 is operatively connected to one of the driving rods 8 by an intermediate mechanical linkage 13 designed to transmit the horizontal movements to the corresponding yarn carrier bar 3 following the angular rotation imparted to the drive shaft itself. Such an intermediate linkage 13 preferably consists of a crank 14 keyed onto the output shaft 12 and operatively engaged to a connecting rod 15 connected to the driving rod 8.

The interconnection between each connecting rod 15 and the respective driving rod 8 is achieved by means of a linking element in the form of a rod 16 slidably guided in a horizontal direction parallel to the movement of the yarn carrier bars 3 on a guide support 17 fastened to the framework 11.

Still referring to the drawing, denoted by 9 is a plurality of microprocessor units interfacing in circuit with a central control unit 7, equipped with a microprocessor of the NEC 78K family and provided with an external key-operated control panel, not shown in the figure.

The microprocessor units 9, assembled on each motor 10 coaxially with the output shaft 12 on the opposite side from the intermediate linkage 13, are cards provided with a microprocessor of the NEC 75X family having their own electrically programmable read only memories (EPROMs) and electrically erasable programmable read only memories (EEPROMs) associated in circuit, through connectors, to an absolute encoder carrying out the detection of the positioning steps of the respective stepping motor and sending a 10-bit signal (according to the known Gray code used in absolute encoders) to the respective microprocessor unit 9. The latter interprets the signal by means of a processing algorithm developed for the purpose.

Each of said microprocessor units is also equipped with the whole interfacing circuitry, through a 485 serial line, with the central control unit 7 and, through optoisolators, with the respective stepping motor 10.

Obviously a power circuitry for the respective supply from the mains is also provided.

Also provided in the power circuitry are capacitors, not shown, that are charged during normal operation thereby giving rise to an energy storage which is available for use.

Therefore the encoder of each microprocessor unit 9 carries out the detection of the angular position of the output shaft 12 of each stepping motor 10 with which it is associated.

This enables the reference zero to be identified for each stepping motor 10.

To this end, during the production test, before delivery to the final user, each of the yarn carrier bar of each knitting machine is brought to a predetermined position, for identifying the reference zero of each motor 10 through detection, by the respective encoder, of the angular position correspondingly taken by the output shaft.

In short, associated with each motor 10 will be a given angle representing the respective reference zero. This reference zero is then sent, in the form of a signal relating to positioning, to the respective microprocessor unit 9 that will interpret it and store it into its own EEPROM.

Both the microprocessor units 9 and central control unit 7 are respectively provided with a control firmware, developed in assembler language, in which reference tables of coded parameters have been logically scheduled, such as: operating speed of the knitting machine, number of angular steps that each motor must correspondingly carry out at each stroke of the yarn carrier bars, value of the distance between centres of the needles (stitch gauge), angular speed, acceleration, deceleration to be imparted to the output shafts of the individual stepping motors, as well as tolerance values and implementation procedures relating to the arranged working cycles.

A remote unit, not shown in the drawing, is also provided and it consists of a personal computer, into which the working cycles designed to be then transferred to unit 7 have been preloaded in the form of Quick-Basic-developed programs.

This transferring is carried out, in connection with the embodiment being described, by an infrared beam system providing for the use of a remote control means that draws the desired working cycles from the personal computer by means of an RS 232 serial line, stores them into random access memories (RAM) provided with a buffer storage and enables them to be transferred to unit 7 through an infrared sensor, provided in said unit 7.

It is to be pointed out that the encoder referred to before and present in each microprocessor unit 9 is of the absolute type, enables a 360° counting, and enables a univocal identification, through the known 10-bit Gray code, of the positioning of the output shaft 12 of each stepping motor 10 which, in connection with the embodiment being described, carries out a complete revolution (360°) in 800 steps.

For the above reason there i s a degree of precision of each motor equal to 0.45, that is 27'. When an operator decides to execute a series of workings, he draws the working cycle or series of working cycles he needs from the remote site (personal computer) through the remote control means and through the remote control means he transmissively discharges that part of the programs that he has drawn from the personal computer.

At this point the knitting machine is ready to execute the working cycle or cycles that are stored in its central control unit 7.

The machine is started and thus all stepping motors 10 are brought to the respective first work position which can coincide with anyone of the angular positions detected by the respective absolute encoder, in connection with the established stitch gauge.

In short, each stepping motor 10 will have its own zero, defined by a certain angular degree detected by the absolute encoder and corresponding to a mechanical zero which i s the same for all of them.

Listed in the EEPROM of each microprocessor unit 9 and sent from the central control unit 7 is a series of tolerance values of angular positioning within which each stepping motor must stop its output shaft at the end of each stroke imparted to the corresponding yarn carrier bar. Such tolerance values, in the form of numerical values referring to the tolerance margins of said angular positionings and processed on the basis of a corresponding algorithm of the control firmware, enable a continuous control of the steps that each motor 10 must carry out in order to move the respective output shaft 12 without exceeding, at the end of each stroke, the margins previously entered during the planning stage.

In addition, according to the process, a series of boundary parameters can be defined, such as the operating speed of the knitting machine, the number of the angular steps that each motor 10 must execute, in observance of the selected working cycle, correspondingly with each stroke of the yarn carrier bar, as well as the stitch gauge value. Such boundary parameters are scheduled into parametric reference tables, logically correlated with each other, within said control firmware, based on a corresponding algorithm.

Also provided by the process is the programming and mutual comparison of the angular speed, acceleration and decelaration values to be given to the output shafts of the individual stepping motors depending on said boundary parameters, in order to establish, at each moment of the selected working cycle, a single resulting positioning value of the respective motor 10 so that, at the end of the yarn carrier bar stroke, the insertion of the threading tubes between the knitting needles be ensure in the observance of the tolerance margins defined in the planning stage.

The foregoing aims at achieving an actual and efficient control of the knitting machine without involving too important mechanical stresses and interferences between the threading tubes and knitting needles.

The above process is embodied by a plurality of procedures of a control programm stored in the form of a firmware into memories of the central control unit 7 and microprocessor unit 9.

More particularly, the above described program procedures are all disposed, as regards the control programming of stepping motors 10, in memories of the central control unit 7 and, as regards the parametric reference tables and tolerance values, in the memories of each microprocessor unit 9.

The working cycles that are not used at the moment, are all loaded in the hard disk of the remote PC.

On the contrary, the working cycle or cycles to be used are loaded in the EPROM of the central control unit 7.

Advantageously, even in case of sudden break of the mains power, each stepping motor 10, supplied with the energy stored in the above capacitors, can residually stop and carryy out a minimum number of steps, so that the corresponding yarn carrier bar is stopped when the respective threading tubes are in alignment with the spaces defined between the consecutive knitting needles.

In particular, in case of break of the electric supply a procedure for stopping each stepping motor is automatically activated, after execution of a residual number of steps, at an angular speed, at an acceleration and/or deceleration that are exclusively dependent on the values of the boundary paramaters at the moment.

Also provided are program selections (procedures) that in addition enable numbering of the axes, which means giving each axis a progressive numbering.

The invention attains the intended purposes.

In fact, by these software procedures, placed in the remote PC, the central unit 7 and the microprocessor unit 9, it is practically possible to control, step by step, the automation of any working cycle feasible through a knitting machine, by adjusting the movement of the yarn carrier bars in relation to the distance between centres of the knitting needles without being any longer bound to mechanical linkages and electromagnetic driving mechanisms, to the operator's choices, and to the necessity for each machine to have the whole execution program required.

Obviously other parameter and circuit modifications are possible without departing from the scope of the invention as defined in the appended claims.

What is claimed is:

1. For use with a knitting machine having: a plurality of yarn carrier bars mounted for horizontal movement in coordination with needle means to achieve a desired knitting pattern; a corresponding plurality of drive motors, each operatively connected to a respective yarn carrier bar; a corresponding plurality of programmable motor control units, each electrically coupled to a respective drive motor; each drive motor having a rotatable output shaft; a programmable central controller electrically coupled to the motor control units; an electrical power supply coupled to the motor control units; and an energy storage means coupled to the motor control units to provide energy for operation of the drive motors and motor control units for a short interval when power from the power supply is unavailable; the method of controlling said knitting machine comprising the steps of:

(a) storing in said central controller a plurality of instructions describing desired horizontal movements of said yarn carrier bars, said instructions defining a working cycle of said knitting machine;

(b) storing in each of said plurality of motor control units at least one operating parameter relating to the movement of the respective yarn carrier bar;

(c) transmitting from said central control unit to each of said plurality of motor control units a movement command corresponding to the desired horizontal movement of the respective yarn carrier bar; and (d) each of said plurality of motor control units responsively executing said movement command consistent with the stored operating parameter to control the respective drive motor to produce the desired movement of the corresponding yarn carrier bar.

2. The method of claim 1 wherein said movement command defines a desired angular position of said drive motor output shaft, and said step of storing in each of said plurality of motor control units at least one operating parameter comprises the step of storing a tolerance value with respect to said desired angular position within which the drive motor is required to stop its output shaft when executing said movement command.

3. The method of claim 2 wherein said step of storing in each of said plurality of motor control units at least one operating parameter comprises the step of storing a representation of a range of permissible angular positions of said drive motor output shaft, and said motor control unit controls said drive motor to maintain said drive motor output shaft position within said range.

4. The method of claim 3 wherein each of said drive motors is a stepping motor; said drive motor output shaft is adapted to rotate in stepwise increments corresponding to a predefined angular displacement; and further comprising the step of:

said motor control unit controlling said drive motor by causing stepwise rotations thereof such that said drive motor output shaft position remains within said range.

5. The method of claim 4 further comprising the step of detecting a number of stepwise rotations executed by said drive motor using an absolute position encoder operatively associated with the output shaft of said motor, said absolute position encoder employing a Gray code.

6. The method of claim 4 further comprising the step of detecting a number of stepwise rotations executed by said drive motor using a 10-bit absolute position encoder operatively associated with the output shaft of said motor.

7. The method of claim 1 wherein said movement command defines a desired angular position of said drive motor output shaft, and said step of storing in each of said plurality of motor control units at least one operating parameter comprises the step of storing a boundary parameter table establishing a relationship between a knitting machine operating speed, a number of angular steps required to achieve a desired drive motor output shaft displacement, and a center-to-center distance measured between adjacent ones of said needle means.

8. The method of claim 7 wherein said step of storing in each of said plurality of motor control units at least one operating parameter comprises the step of selecting an angular speed for said drive, an acceleration for said drive motor shaft, and a deceleration for said drive motor shaft, responsive to at least one entry in said boundary parameter table.

9. The method of claim 8 wherein each of said drive motors is a stepping motor; said drive motor output shaft is adapted to rotate in stepwise increments corresponding to a predefined angular displacement; and further comprising the step of:

said motor control unit controlling said drive motor by causing stepwise rotations thereof such that said drive motor exhibits an an angular speed for said drive, an acceleration for said drive motor shaft, and a deceleration for said drive motor shaft, which is consistent with said selected angular speed, acceleration, and deceleration, and which is responsive to at least one entry in said boundary parameter table.

10. The method of claim 9 further comprising the step of:

responding to a loss of electrical power from said power supply by operating said drive motor for a selected number of residual operating steps, at a selected angular speed, at a selected acceleration, and at a selected subsequent deceleration, said selections being exclusively dependent on current entries in said boundary parameter table.

11. The method of claim 10 further comprising the step of supplying power to operate said drive motor during said residual operating steps from said energy storage means, said energy storage means being at least one capacitor coupled to said power supply circuit and arranged to store power during normal operation.

12. The method of claim 9 further comprising the step of:

responding to a loss of electrical power from said power supply by operating said drive motor for a selected number of residual operating steps, at a selected angular speed, at a selected acceleration, and at a selected subsequent deceleration, said selected number of residual operating steps being the smallest number of steps required to place the corresponding yarn carrier bar in a predetermined location.

13. The method of claim 1 wherein said step of storing in said central controller a plurality of instructions further comprises the step of storing computer program steps in at least one EPROM assembled in the central controller.

14. The method of claim 1 wherein said step of storing in each of said plurality of motor control units at least one operating parameter further comprises the step of storing said operating parameter as a part of a computer program in at least one PROM assembled in each of the motor control units.

15. The method of claim 1 further comprising the step of detecting the position of the output shaft of each of said drive motors using an absolute position encoder operatively associated therewith.

16. The method of claim 1 further comprising the steps of:

providing means external to said knitting machine for storing instructions corresponding to at least one working cycle of said knitting machine;

providing optical means for coupling said external instruction storage means to said knitting machine; and transferring said instructions from said external storage means to said knitting machine through said coupling means.

17. A control system for use with a knitting machine having a plurality of yarn carrier bars mounted for horizontal movement in coordination with needle means to achieve a desired knitting pattern; a corresponding plurality of drive motors, each operatively connected to a respective yarn carrier bar; a corresponding plurality of programmable motor control units, each electrically coupled to a respective drive motor; each drive motor having a rotatable output shaft; a programmable central controller electrically coupled to the motor control units; an electrical power supply coupled to the motor control units; and an energy storage means coupled to the motor control units to provide energy for operation of the drive motors and motor control units for a short interval when power from the power supply is unavailable; said control system comprising:

(a) means for storing in said central controller a plurality of instructions describing desired horizontal movements of said yarn carrier bars, said instructions defining a working cycle of said knitting machine;

(b) means for storing in each of said plurality of motor control units at least one operating parameter relating to the movement of the respective yarn carrier bar;

(c) means for transmitting from said central control unit to each of said plurality of motor control units a movement command corresponding to the desired horizontal movement of the respective yarn carrier bar; and (d) each of said plurality of motor control units responsive to said central control unit for executing said movement command consistent with the stored operating parameter, each of said motor control units controlling the respective drive motor to produce the desired movement of the corresponding yarn carrier bar.

* * * * *